US012188154B2

(12) United States Patent
Beaven

(10) Patent No.: US 12,188,154 B2
(45) Date of Patent: Jan. 7, 2025

(54) METHOD AND APPARATUS FOR DECORTICATING PLANT STALKS

(71) Applicant: David G. P. Beaven, Hope (CA)

(72) Inventor: David G. P. Beaven, Hope (CA)

( * ) Notice: Subject to any disclaimer, the term of this patent is extended or adjusted under 35 U.S.C. 154(b) by 0 days.

(21) Appl. No.: 17/410,052

(22) Filed: Aug. 24, 2021

(65) Prior Publication Data

US 2022/0056618 A1 Feb. 24, 2022

(30) Foreign Application Priority Data

Aug. 24, 2020 (CA) ..... CA 3090976

(51) Int. Cl.
*D01B 1/16* (2006.01)
*D01B 1/22* (2006.01)
*D01B 1/30* (2006.01)

(52) U.S. Cl.
CPC ..... *D01B 1/16* (2013.01); *D01B 1/22* (2013.01); *D01B 1/30* (2013.01)

(58) Field of Classification Search
CPC ... D01B 1/14; D01B 1/16; D01B 1/20; D01B 1/34; D01B 1/36; D01B 1/46; A01D 45/06
USPC ..... 19/5 R, 10
See application file for complete search history.

(56) References Cited

U.S. PATENT DOCUMENTS 2,738,552 A * 3/1956 Bok ..... D01B 1/22 19/23
2016/0270315 A1* 9/2016 Paulitz ..... D01B 1/16

FOREIGN PATENT DOCUMENTS

CN 110670143 A * 1/2020 ..... D01B 1/20
GB 191109834 A * 4/1912 ..... D01B 1/14
GB 207982 A * 12/1923 ..... D01B 1/14
GB 240786 A * 7/1926 ..... D01B 1/14

* cited by examiner

*Primary Examiner* — Aiying Zhao

(57) ABSTRACT

Method and apparatus for decortication of plant stalks, involving flattening the plant stalk into two substantially planar stalk sides adjoined at their edges; splitting the two substantially planar stalk sides one from the other; bending the flat stalk piece with the hurd on the outside of the bend and bast on the inside of the bend; separating the segments such that the bast pulls away from the hurd and spans the gap between the two segments; bringing a stripper into abutment with the spanning bast and moving the stripper so as to draw the bast, which strips the bast away from the hurd; and removing the bast from the stripper.

10 Claims, 15 Drawing Sheets

METHOD AND APPARATUS FOR DECORTICATING PLANT STALKS

FIELD OF THE INVENTION

The present invention relates to the field of decortication of plant stalks.

BACKGROUND OF THE INVENTION

Natural fibers include: seed fibers (cotton, kapok), bast fibers (kenaf, flax, hemp, jute, and ramie), leaf or hard fibers (sisal, pineapple), and fruit fibers (coconut coir). The bast and leaf fibers are the most commonly used fibers in composite applications.

Bast fiber (also called phloem fiber or skin fiber) is a long plant fiber collected from the phloem (the "inner bark", sometimes called "skin") or bast, which essentially comprises the outer wall of the stalk of certain plants. The bast includes or supports the conductive cells of the phloem and provides structural strength to the stalk. Bast fibers have a variety of uses, including in fabrics, e.g., flax (linen), hemp and ramie (a linen-like fabric).

A hemp stalk generally has a substantially circular cross-section in which the bast surrounds and supports the hurd, which comprises the inner woody core of the stalk. The hurd comprises short fibers (in hemp, about 0.5 mm). In a hemp stalk, the hurd comprises about 70-80% of the stalk by weight. Hemp hurd typically contains 20-30% lignin.

Hemp has been grown for bast fiber for millennia. Hemp bast is primarily used in textiles, but the length, tensile strength All conventional decorticators use the same hundred year old technology, employing a hammer mill or alike slow motion "beating" action, which damages bast fiber and causes attrition of hurd fiber. Damage to bast fiber destroys the structural fiber bundles required for effective contemporary reinforcement applications. and flexibility of bast fibers makes them suitable for a wide range of industrial applications including: bio-composites, construction materials, textiles, insulation, bedding, paper production, and ropes and twines. Until recently, hurd was essentially considered to be a waste by-product, and breeding efforts aimed at developing new hemp varieties were primarily directed to increasing the hemp stalk's bast fiber content. However, related to the significant revival of hemp production in the past few decades, applications for hurd have been developed, for example, hemperete, which is a non-weight bearing insulating material used in building construction.

As the bast and hurd are both usable materials, but have different configurations and uses, it is desirable to cleanly separate them (i.e., without cross-contamination), with minimal waste of, or damage to, either.

Decortication is a general term for the removal of the bark, husk, or outer layer, or peel of an object. In hemp fiber production, decortication refers to the separation of the bast and hurd from each other.

The known decortication methods for hemp stalks generally involve some form of mechanical separation, employing a hammer mill or similar apparatus providing a slow-motion "beating" action to loosen the bond between the bast and the hurd. The most widely used approach to such manual beating of the hemp stalk is referred to as scutching. Scutching physically dislodges the hurd from the bast, but current large-scale operations require multiple passes to obtain bast fibers that are sufficiently clean of hurd to be textile quality fiber. Such beating and multiple passes tend to damage the bast fiber and result in lost of hurd fiber. The damage to bast fiber may include a degradation of the structural fiber bundles desired for contemporary reinforcement applications.

It is also known to use ultrasonic sound waves to break the bond between fiber and hurd. It is understood that in addition to breaking the bond between the bast and hurd, such ultrasonically induced vibrations may also degrade the integrity of the bast structural fiber bundles

SUMMARY OF THE INVENTION

In one aspect, the present invention provides a method for decorticating a length of plant stalk comprising an inner hurd and an outer bast, that exploits the differences between the hurd and bast in terms of flexibility and frangibility, being that compared to the bast, the hurd is less flexible and is more frangible, i.e., more likely to break laterally. As a result, when a stalk is split lengthwise so as to produce two stalk pieces, each comprising a layer of bast and a layer of hurd, flattening a one of the stalk pieces and then bending the flattened stalk piece over a suitably shaped bend member with the bast on the inside of the bend and hurd on the outside of the bend, will break the hurd at the bend but not the bast. Depending on the shape of the bend in the bast induced by the bend member, some amount of hurd at either side of the break in the hurd may separate from the adjacent bast.

The method may include, with the stalk piece under sufficient tension, moving the bend along the length of the stalk piece (by moving the bend member along the stalk piece, or drawing the stalk piece across the bend member, or both concurrently or sequentially) so as to cause hurd to separate from adjacent bast as the bend passes the hurd.

Alternatively, if the bend member comprises: two sub bend members that may be separated, or a second bend member may be moved adjacent the first bend member and the first and second band members may be separated, then if the bend members are suitably configured, separating the bend members with the stalk piece under tension causes the bend formed in the bast at the break in the hurd, to move along the length of the bast away from the break. Such a moving bend causes hurd to separate from adjacent bast as the bend passes the hurd.

Further, this separating of the bend members results in a section of hurdless bast spanning the gap between the bend members. Causing a stripper member to pass through the gap, proceeding from the former hurd side of the bast, causes the bast to be drawn past both bend members thus moving bends along the bast on either side of the stripper member and again causing the hurd to separate from the adjacent bast as the bends pass.

In another aspect, the present invention provides a method for decorticating a piece of a plant stalk comprising an outer hurd and an inner bast, the method including: splitting the piece of plant stalk lengthwise to create a plurality of plant stalk sections, each section having a bast side, a hurd side and two ends; bending a one of the plant stalk pieces about a bend member, with the hurd on the outside of the bend and bast on the inside of the bend, so as to break the hurd layer without severing the bast layer; moving a turn member from the vicinity of the bend member along the bast so as to cause a turn to move along the bast, thus separating the bast from the hurd as the turn passes, resulting in a portion of bast spanning a gap between the bend member and the turn member; and drawing the spanning portion of bast past the bend member and the turn member, so as to cause turns to move along the bast to the ends of the plant stalk section, thus separating the bast from the hurd as the turns pass.

The method may include flattening the piece of plant stalk prior to or concurrently with the splitting step. The flattening step may include passing the piece of plant stalk between opposed rollers.

The drawing step may include moving a stripper member through the gap between the bend member and the turn member, so as to fold the bast about the stripper member. The method may include removing the folded bast from the stripper member.

The plurality of plant stalk sections may be two plant stalk sections.

In another aspect, the present invention provides a method of decorticating a length of a plant stalk comprising an inner hurd and an outer bast, the method involving:

a) passing the length of plant stalk between opposed rollers so as to flatten the plant stalk into two substantially planar stalk sides adjoined at their edges;

b) splitting the two substantially planar stalk sides one from the other by interposing a splitter between the two substantially planar sides and passing the length of the flattened plant stalk across the splitter so as to sever the adjoined edges, thus creating two flat stalk pieces, each comprising a hurd layer and a bast layer, the bast layer having an inner surface (contacting the hurd in the living plant) and an outer surface;

c) at a location in the vicinity of the mid-length of a one of the flat stalk pieces, bending the flat stalk piece with the hurd on the outside of the bend and bast on the inside of the bend, so as to break the hurd layer without severing the bast layer, thus creating two segments joined one to the other by spanning bast at the bend;

d) separating the segments such that the bast pulls away from the hurd and spans the gap between the two segments, and pivoting the two segments relative to each other so that the segments define lines intersecting at an acute angle;

e) providing two turning wedges, each positioned at the outer surface adjacent a respective end of the bast spanning the gap between the two segments;

f) bringing a stripper into abutment with the inner surface of the spanning bast and moving the stripper between the turning wedges so as to fold the bast between the wedges and the stripper, thus drawing the bast, which both strips the bast away from the hurd and causes each segment to move longitudinally past the respective turning wedge propelling the thus separated hurd to a hurd receiver; and g) removing the folded bast from the stripper.

In another aspect, the present invention provides an apparatus for decorticating a piece of plant stalk having an outer bast and an inner hurd, the apparatus includes: a splitter for splitting the piece of plant stalk lengthwise to create a plurality of plant stalk sections, each section having a bast side, a hurd side and two ends; a bend member about which to make a bend in a one of the plant stalk pieces, with the hurd on the outside of the bend and bast on the inside of the bend, so as to break the hurd layer without severing the bast layer; a turn member for moving along the bast from the vicinity of the bend member, thus causing a turn to move along the bast, separating the bast from the hurd as the turn passes, resulting in a portion of bast spanning a gap between the bend member and the turn member; and a stripper member for passing through the gap between the bend member and the turn member, so as to fold the bast about the stripper member and draw the bast past the bend member and the turn member, so as to cause turns to move along the bast to the ends of the plant stalk section, thus separating the bast from the hurd as the turns pass.

The apparatus may include an infeed assembly for flattening the piece of plant stalk and bringing the flattened piece of plant stalk into engagement with the splitter.

The stripper member may be a first stripper blade mounted at a first end of a rotatable beam and the first stripper blade is curved with a constant radius about an axis of rotation of the rotatable beam. The apparatus may include a second stripper blade mounted at a second end of the rotatable beam opposite the first stripper blade.

The bend member may include a movable draw bar.

The apparatus may include an assembly for removing bast from the stripper member. The assembly for removing bast from the stripper member may include a rotatable belt positioned so as to engage a leading edge of the stripper member about which the bast is folded. The assembly for removing bast from the stripper member may include a shoe-type extractor.

DETAILED DESCRIPTION WITH REFERENCE TO THE DRAWINGS

Figure 1:
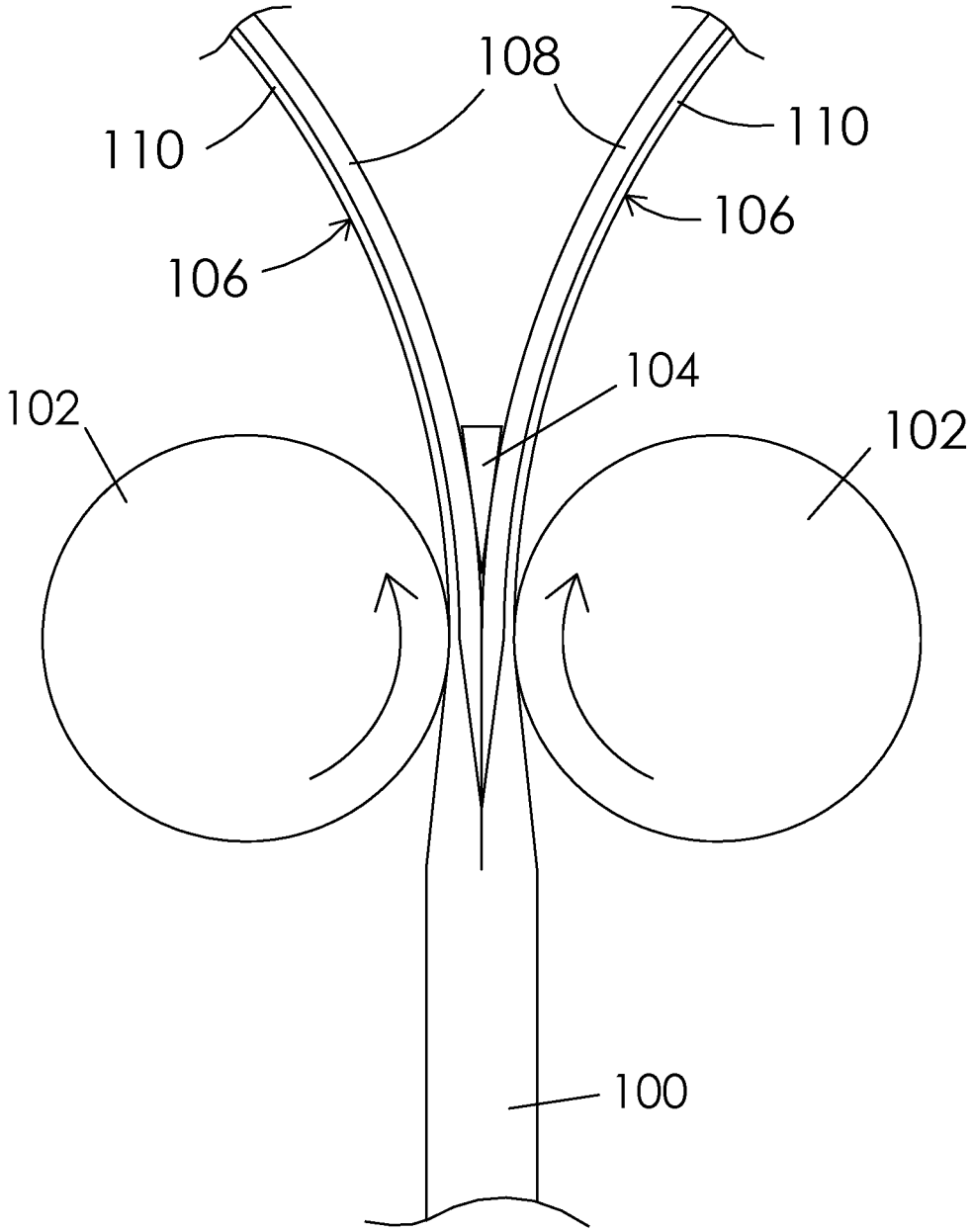
FIGS. 1 through 6 are schematic representations of aspects of a method embodiment of the present invention.

As shown in the drawings, embodiments of the present invention include a decorticating method and apparatus.

FIGS. 1 through 6 are schematic representations of aspects of an embodiment of the decorticating method of the present invention.

FIG. 1 shows the steps of flattening and splitting a hemp stalk 100. In the embodiment shown in FIG. 1, the flattening is accomplished by passing the hemp stalk 100 lengthwise between two opposed rotating cylinders 102; and the splitting is accomplished by passing the flattened hemp stalk 100 lengthwise across a splitter member 104. The splitting produces two flat stalk pieces 106, each flat stalk piece 106 comprising a layer of hurd 108 and a layer of bast 110.

In the embodiment shown in FIG. 1, the rotation of the two opposed cylinders 102 both flattens the hemp stalk 100 and propels the hemp stalk 100 into engagement with the splitter member 104. In another embodiment, there are two pairs of opposed rotating cylinders, a first upstream pair that flattens the hemp stalk 100 and a second pair of opposed rotating cylinders that propel the hemp stalk into engagement with the splitter member. Preferably, the first upstream pair of rollers are "grabbing-type", in that they are made of a flexibly resilient material to better grab the stalks and to accommodate stalks of different diameters.

As indicated in FIG. 1, in some instances (e.g., with thicker stalks), the flattening will cause the hurd 108 and bast 110 at the edges of the flattened hemp stalk to break, such that the splitter member 104 essentially merely separates the resulting two flat stalk pieces 106 one from the other. In other instances, the flattening does not cause the hurd 108 and bast 110 at the edges of the flattened hemp stalk to break, and the splitter member 104 cuts the length of the flattened hemp stalk 100 so as to both create and separate the two flat stalk pieces 106. As a result, it is desirable for the splitter member 104 to have a sharp cutting edge.

The inventor understands that in the living hemp stalk, the bast 110 slightly compresses the hurd 108, which provides an element of structural stability in the standing stalk (i.e., it keeps the stalk straight and upright), and induces the curve in the flat stalk pieces 106 indicated in the drawings, in that as the hurd 108 is no longer enclosed within the encircling bast 110, the hurd 108 expands slightly. This is a natural feature of a hemp stalk that facilitates the splitting of the hemp stalk.

Figure 2:
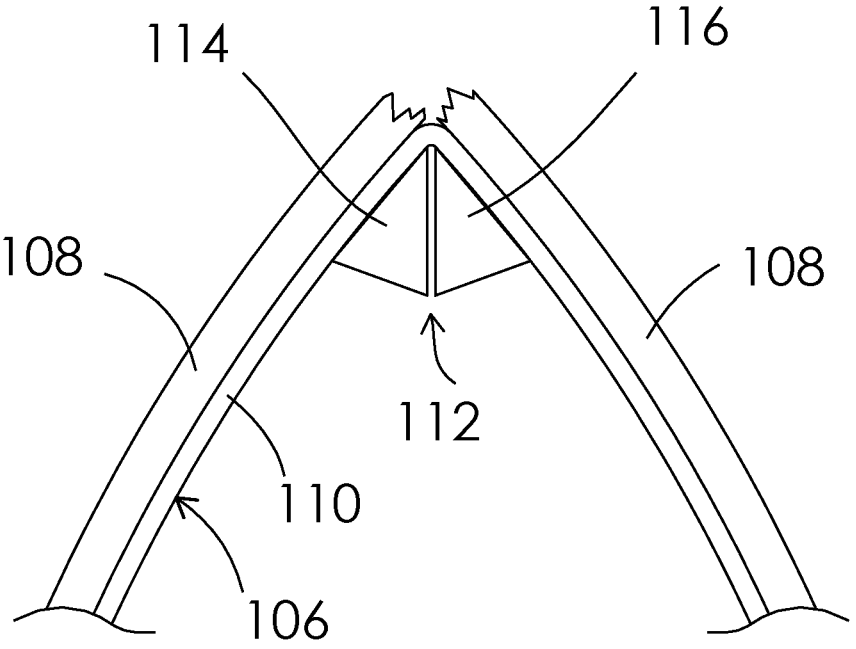

FIG. 2 illustrates the bending of a one of the flat stalk pieces 106 about a bend member 112, with the hurd 108 on the outside of the bend and the bast 110 on the inside of the bend. Due both to the basic geometry of the bend (i.e., the hurd 108, being on the outside of the bend, is under greater tension at the bend than the bast 110) and the hurd 108 being inherently more frangible than the bast 110, the hurd 108 breaks at the bend.

Figure 3:
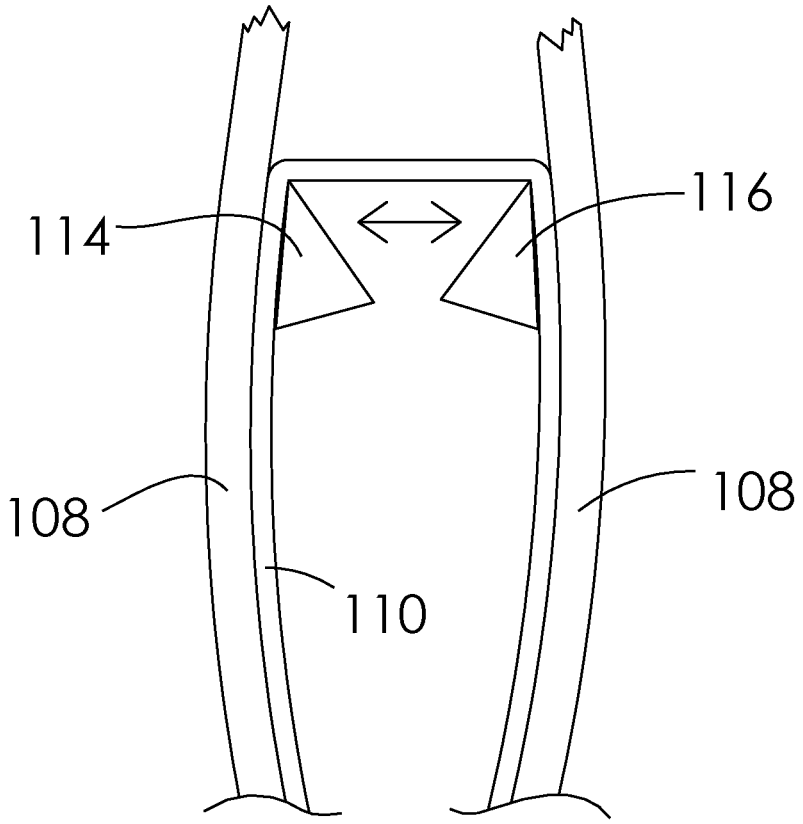

FIG. 3 illustrates spreading draw edges (a first draw edge 114 and a second draw edge 116) in opposite directions away from the bend, so as to cause turns that move along the bast 110 and that thus separate the bast 110 from the hurd 108 as each turn passes (because, generally, the hurd 108 cannot accommodate the turn). The strength of the bond between the hurd 108 and the bast 110 varies (e.g., the bond is generally stronger in dried stalks than in freshly harvested stalks). When the bond is strong, it is desirable that there be little or no slack in the bast 110 at each turn (i.e., that the bast 110 not be unsupported), as slack may result in the hurd 108 also accommodating the turn, i.e., by breaking into short segments and staying bonded to the bast 110.

In the Figures, the bend member 112 comprises the first draw edge 114 and the second draw edge 116, and once the bending has been accomplished (or as the bending is underway), the first draw edge 114 and the second draw edge 116 separate to cause the turns that move along the bast 110 in opposite directions. Alternatively, the bend member 112 may be a one of the draw edges and a further draw edge may be introduced adjacent the bend member 112, and the bend member and further draw edge may be separated one from the other to cause the turns that move along the bast 110 in opposite directions. As a further alternative, two draw edges may be interposed adjacent the bend member 112, one on each side, and then separated away from the bend member to cause the turns that move along the bast 110 in opposite directions (and the bend member may withdraw).

FIG. 3 indicates that the first draw edge 114 and second draw edge 116 both move when separating (thus creating moving turns at each draw edge, resulting in roughly equal amounts of hurd 108 projecting away from the two draw edges). Alternatively, only one of the draw edges may move.

Figure 4:
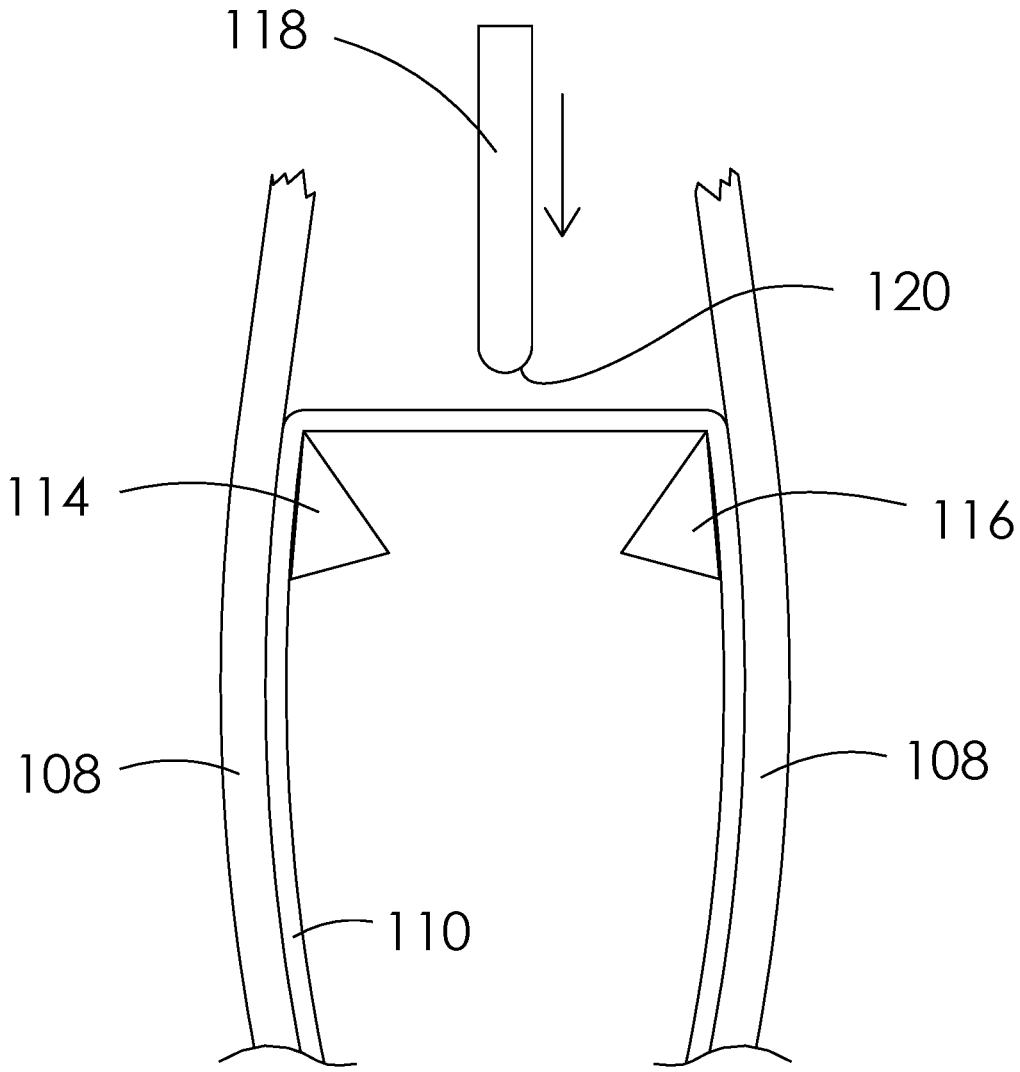
Figure 5:
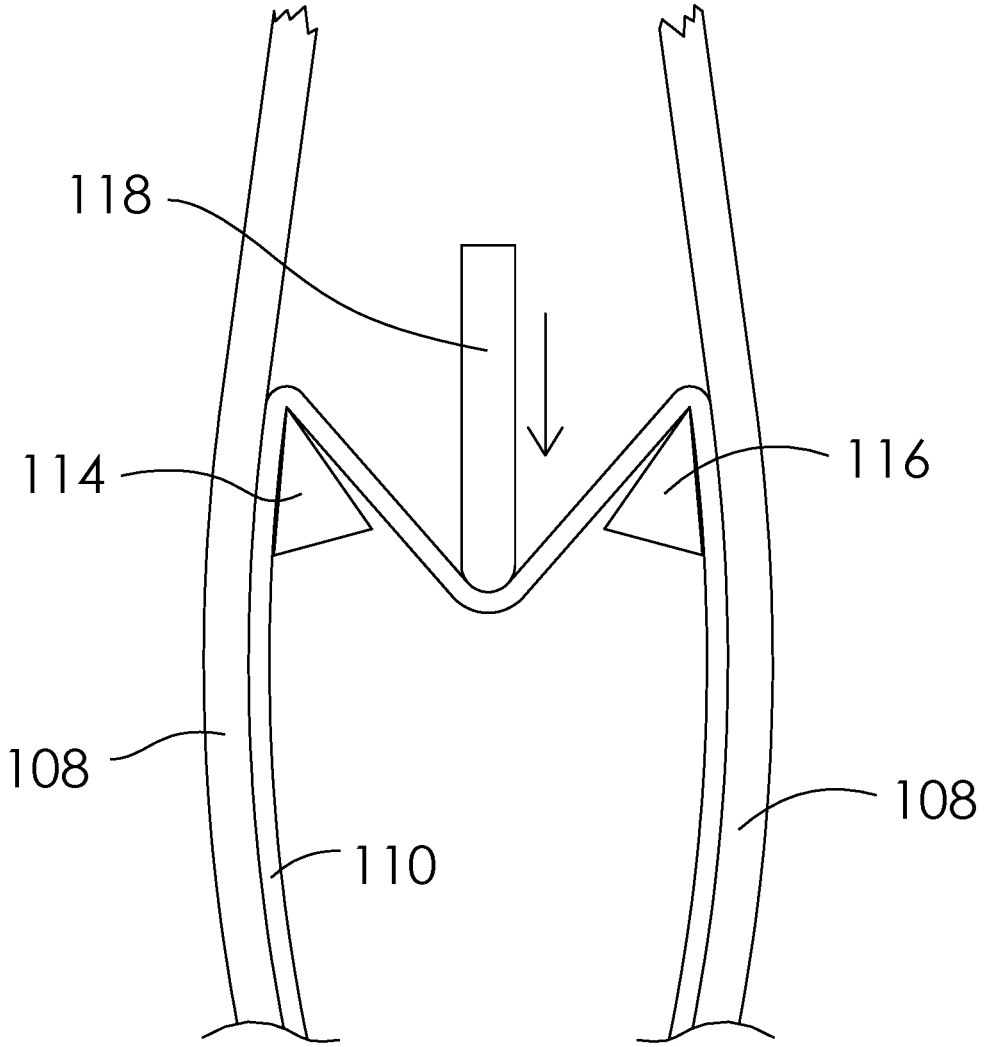
Figure 6:
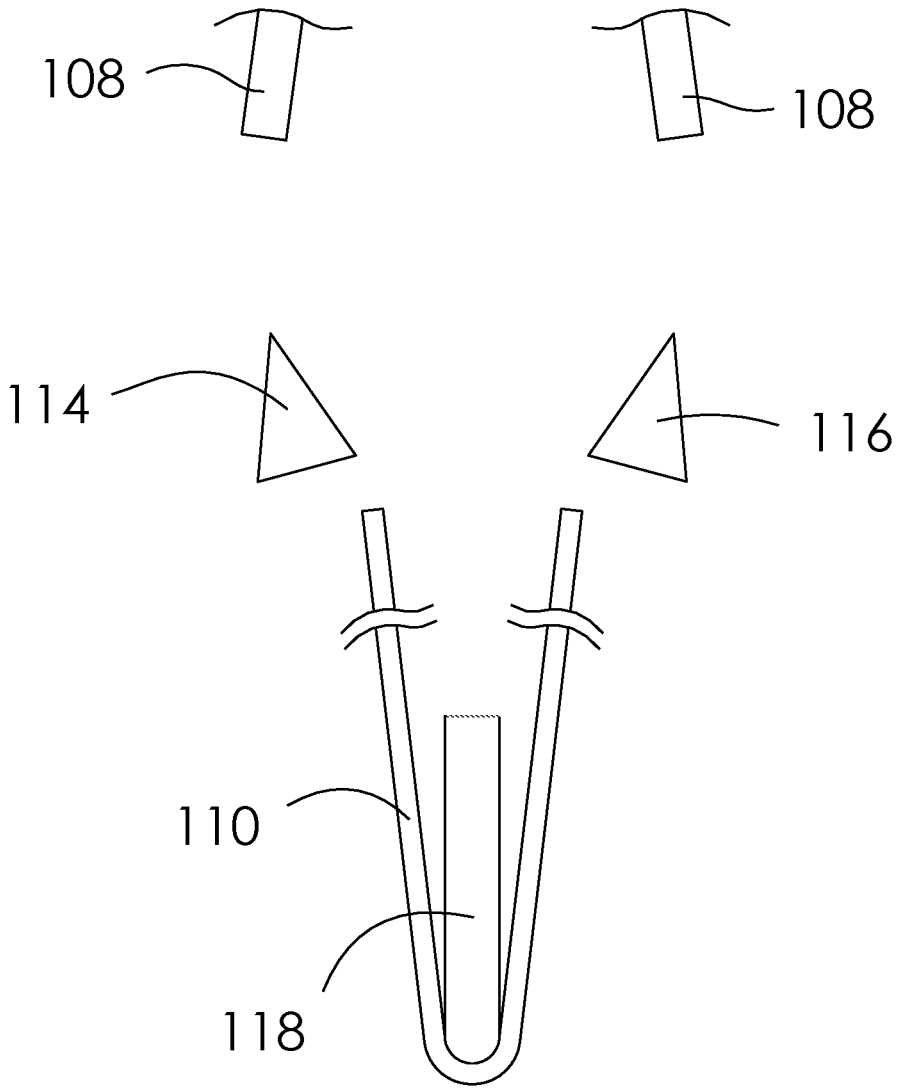
Figure 7:
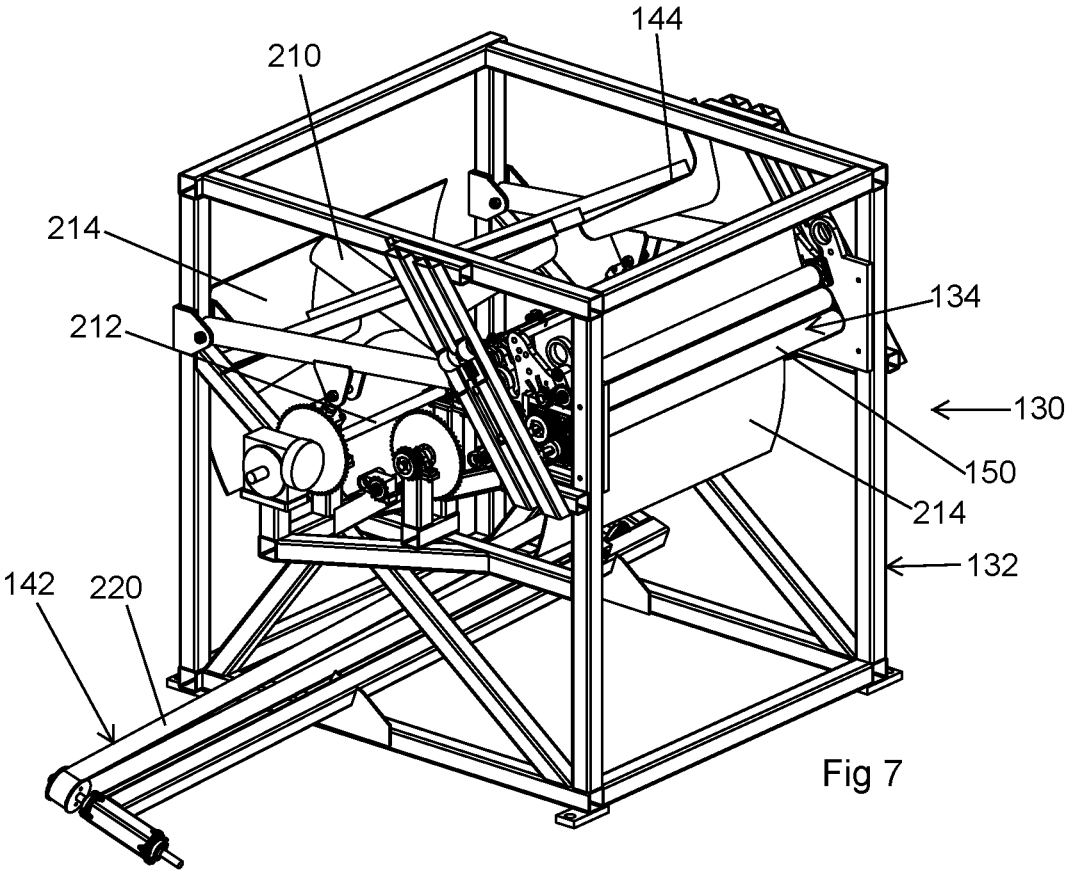
FIG. 7 is a perspective view of an apparatus embodiment of the present invention showing the infeed side and a side of the apparatus.
Figure 8:
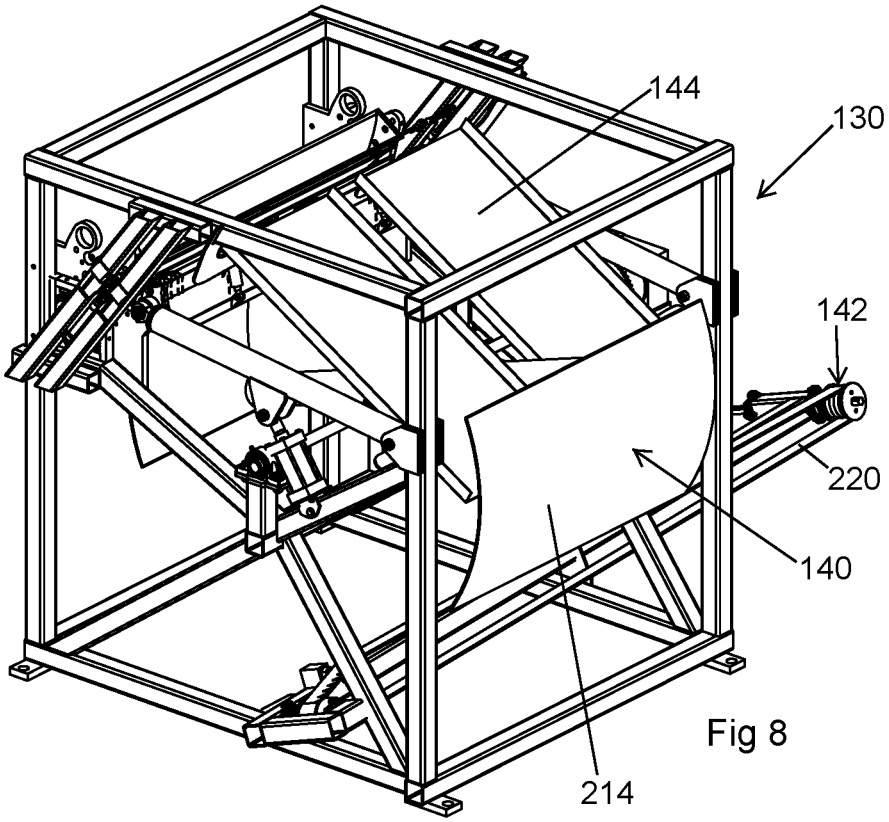
FIG. 8 is a perspective view of the apparatus of FIG. 7, showing the sides opposite to those shown in FIG. 7.
Figure 9:
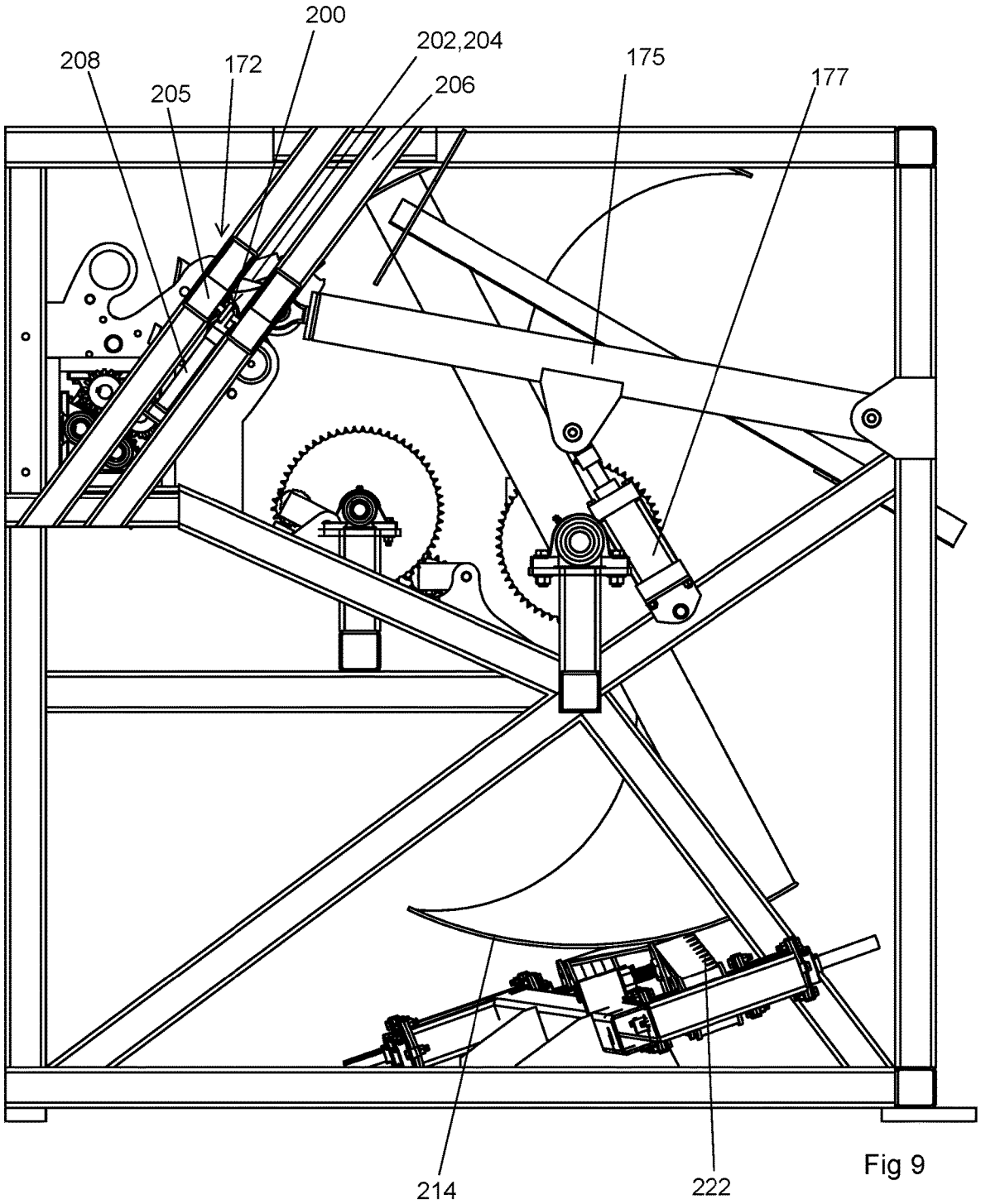
FIG. 9 is side elevation view of the apparatus of FIG. 7, with the infeed side on the left of the drawing.

FIGS. 4 to 6 illustrate the folding of the bast 110 and resulting stripping of the bast 110 from the hurd 108 at each draw edge.

As indicated in FIGS. 4 and 5, once the first draw edge 114 and second draw edge 116 are sufficiently separated, a stripper member 118 moves from the hurd side of the bast 110 through the gap between the first draw edge 114 and second draw edge 116, thus folding the bast 110 at the shoulder 120 of the stripper member 118. As the stripper member 118 moves, it draws the portions of bast 110 extending from each side of the fold, past the first draw edge 114 and the second draw edge 116, thus stripping the bast 110 from the hurd 108.

The angle between the portions of bast on each side of a draw edge is referred to at times herein as the turn angle. To facilitate the separation of the bast 110 from the hurd 108, the turn angle is preferably no more than about 90 degrees, more preferably no more than about 60 degrees and even more preferably no more than about 45 degrees.

In the schematic representations in FIGS. 3 and 4, during the time when the draw edges 114, 116 are separating and when the draw edges 114, 116 are at full separation but before the shoulder 120 contacts the bast, the turn angle is about 90 degrees.

In the schematic representation in FIG. 5, with the stripper member 118 folding the bast 110, the turn angle is about 45 degrees. It will be apparent that the turn angle will not be less than the angle defined by the respective draw edge (114, 116), being about 40 degrees in FIG. 5.

With a sufficiently acute turn angle, the bast 110 is pulled away from the hurd 108 in a motion that has a component that is opposite the motion of the hurd 108. If the stripper member 118 moves with sufficient velocity, the momentum of the hurd 108 and the opposite components of motion of the bast 110 and hurd 108 as they pass the respective draw edge 114, 116, result in a clean and complete separation of the hurd 108 and bast 110 at each end of the flat stalk piece 106, and as indicated in FIG. 6, tends to propel the hurd 108 away from the draw edge 114, 116 (usefully clearing the vicinity of the draw edges 114, 116 for further use).

Preferably, the bend member 112, first draw edge 114, second draw edge 116, stripper member 118 and shoulder 120, are longitudinally extending (in use positioned to extend laterally to the longitudinal extent of the hemp stalk 100 and flat stalk piece 106) such that the steps of the method may be applied concurrently to a plurality of aligned stalks.

The method is best used with hemp stalk 100 that have been de-stemmed and cut to substantially uniform lengths. The method may include one or both of the steps of de-stemming hemp stalks and cutting the hemp stalks.

The method may also include the step of providing hemp stalks for the flattening step (e.g., feeding the hemp stalks to the flattening rolling cylinders).

The step of providing hemp stalks for the flattening step may include aligning a plurality of hemp stalks.

The inventor understands that the providing and aligning of the hemp stalks may be usefully accomplished by performing the method embodiment described herein, in the field as the hemp stalk is harvested (i.e., with the method performed using a mobile agricultural implement), which may provide for a desirably controlled stock infeed alignment while reducing handling (and eliminating the need for post-harvest alignment equipment) Hemp is conventionally grown in distinct rows. The inventor understands that ready-for-harvest hemp could be prepared by cutting off the top portion each plant (and presumably conveying it away), then, as the resulting standing stalks have an established top end, cutting the stalks (whether in the ground or out) at a location to provide the desired length for the apparatus implementing the method, thus accomplishing the providing and aligning steps essentially concurrently.

The method preferably includes removing the folded bast from the stripper member and collecting the bast. The method also preferably includes collecting the hurd.

Apparatus embodiments of the present invention are shown in FIGS. 7-16.

The decorticating apparatus 130 includes: a frame 132; an infeed assembly 134; a splitter assembly 136; a bender and draw assembly 138; a stripper assembly 140; a bast extraction conveyor assembly 142; and hurd discharge chutes 144.

To be clear, the drawings show only a portion (roughly half) of the contemplated embodiment, in that the shown splitter assembly 136 divides the plant stalk into two sets of flat stalk pieces that diverge for separate processing, but the drawings show the components for subsequent processing of only one of the sets of flat stalk pieces that is directly fed to the shown components. It is contemplated that an actual installation would include additional components substantially mirroring the shown components, with equivalent components equidistant from a plane bisecting the infeed assembly and splitter assembly. Alternatively, the apparatus could be configured so that both sets of stalk pieces are fed sequentially to the same bender and draw assembly 138 etc. One set of flat stalk pieces would be directly fed to the bender and draw assembly 138 as indicated in the drawings, and the other set of flat stalk pieces would be turned (so as to be properly oriented for processing) and then fed to the bender and draw assembly 138.

The frame 132 comprises steel structural elements (e.g., tubing) configured to support the other components. In some of the drawings, all or part of the frame 132 is not shown to better illustrate other components.

The infeed assembly 134 comprises: flattening rollers 150 for receiving plant stalks and flattening each plant stalk, which may or may not break the bast and hurd at the edges of the flattened stalk, depending primarily on the thickness of the stalk; and feed rollers 152 for frictionally engaging the flattened stalks and bringing the flattened stalks into engagement with the splitter assembly 136.

The splitter assembly 136 comprises; a generally V-shaped splitter 160 terminating in the splitter knife 162; and a splitter containment wall 164. The splitter containment wall 164 and the V-shaped splitter 160 define the splitter duct 166.

The bender and draw assembly 138 comprises: a separator assembly 170 and a movable draw assembly 172.

The separator assembly 170 includes: a separator body 174 defining a separator body duct 176, and a stalk clamp assembly 178.

The stalk clamp assembly 178 comprises a clamp cam 180 pivotally mounted to the separator body 174 and a clamp air ram 182 mounted between the clamp cam 180 and the separator body 174, wherein the clamp cam 180 and clamp air ram 182 are configured such that actuating the clamp air ram 182 causes the clamp cam 180 to pivot between: a clamp position 184, in which the clamp cam 180 projects into the separator body duct 176 (in use, so as to impede longitudinal movement of flat stalk pieces 106 in the separator body duct 176); and a clear position 186, in which the clamp cam 180 does not project into the separator body duct 176.

The separator body 174 is pivotally mounted relative to the splitter assembly 136, wherein the separator body 174 is pivotable between a stalk-receiving position 190 in which the separator body duct 176 is aligned with the splitter duct 166 such that in use, the separator body duct 176 may receive flat stalk pieces from the splitter duct 166; and a separation position 192 in which the separator body duct 176 and splitter duct 166 are, in a rough sense, parallel to each other. The proximal end of the separator body duct 176 (i.e., the end of the separator body duct 176 closest to the splitter duct 166 when the separator body 174 is in the stalk-receiving position 190) includes a separator draw 188.

Movement of the separator body 174 between the stalk-receiving position 190 and the separation position 192, is effected by a separator body pivot beam 175 and separator body air ram 177.

The movable draw assembly 172 comprises: a draw bar 200 (in the embodiment illustrated in the drawings, the draw bar 200 is a section of steel wire rope 202 kept under a desired tension by a turnbuckle 204); and at each end of the draw bar 200: a draw bar roller 205 positioned within draw bar roller tracks 206 (in the embodiment illustrated in the drawings, the draw bar tracks 206 comprise square tubing with cutouts configured to receive and guide the ends of the draw bar rollers 205), and a draw bar air ram 208 for moving the draw bar 200 between a retracted position 194 (in which the separator body 174 is in the stalk-receiving position 190 and the draw bar 200 is adjacent the separator draw 188) and a turn position 196 (in which the separator body 174 is in the separation position 192 and the draw bar 200 is: displaced from the distal end of the splitter duct 166; and roughly aligned with a linear extension of the path defined by the splitter duct 166).

The stripper assembly 140 comprises: a stripper beam 210; a stripper shaft 212 to which the stripper beam 210 is mounted for rotational movement about the axis of rotation of the stripper shaft 212; two stripper blades 214, one at each end of the stripper beam 210; and a stripper friction roller 216. The stripper blades 214 are curved in a constant radius about the axis of rotation of the stripper shaft 212. The stripper friction roller 216 is positioned and configured to abut each stripper blade 214 so as to temporarily secure bast 110 between the stripper blade 214 and the stripper friction roller 216.

As indicated in the drawings, the stripper assembly 140 includes elements that pass through the bender and draw assembly 138. This through motion is achieved by the bender and draw assembly 138 comprising a combination of full-width components and cooperating opposed cantilevered components. Between the distal ends of the cantilevered components is a space through which the stripper beam 210 may pass so as to interpose the stripper blades 214 between the full-width and cantilevered components of the bender and draw assembly 138. At times in what follows, the cantilevered components are described as if there is only one of each such component, wherein generally there are two similar components (substantially mirror images of each other).

The bast extraction conveyor assembly 142 comprises a rotatable belt 220 located so as to contact each stripper blade 214 as it rotates past, with the belt 220 oriented at an acute angle to the leading edge of the stripper blade 214, so as to progressively contact portions of the leading edge of the stripper blade 214, rather than simultaneously contacting the full length of the leading edge of the stripper blade 214, as the belt would if it were parallel to the leading edge of the stripper blade 214. The belt 220 preferably includes asymmetrical V notches 222 configured to dislodge bast folded about the leading edge of the stripper blade 214.

As shown in the drawings, the hurd discharge chutes 144 comprises chutes for receiving hurd 108 from the vicinity of the bender and draw assembly 138, and conveying the hurd 108 to outside the frame 132. The chutes shown in the drawings are simple troughs relying on gravity to move the hurd 108 as desired. The hurd discharge chutes could of course include means for positively moving the hurd 108, e.g., conveyor belts.

Figure 10:
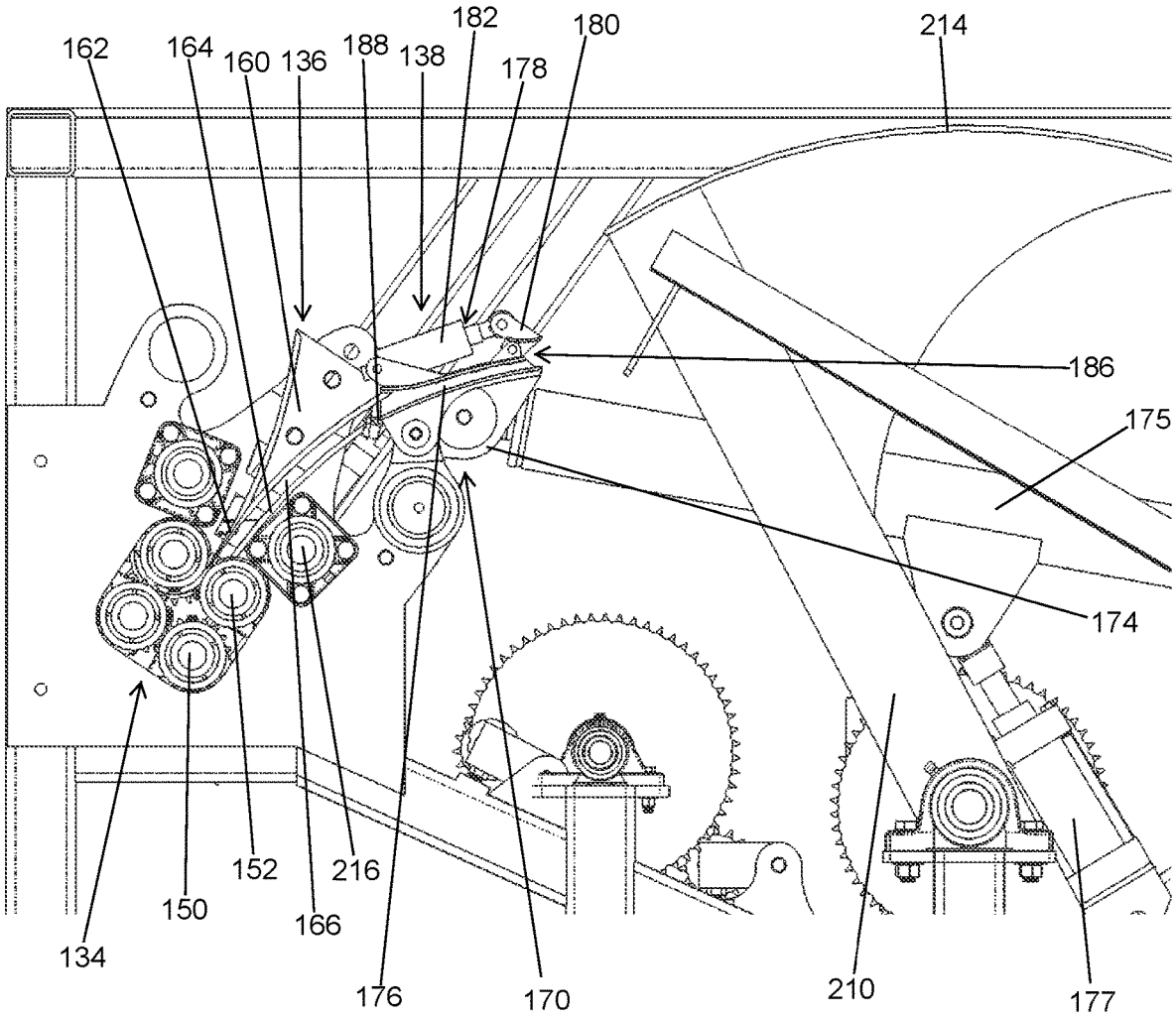
FIG. 10 is a side elevation isolation view of a portion of the apparatus of FIG. 7, featuring infeed, splitter, separation and stripper components.
Figure 11:
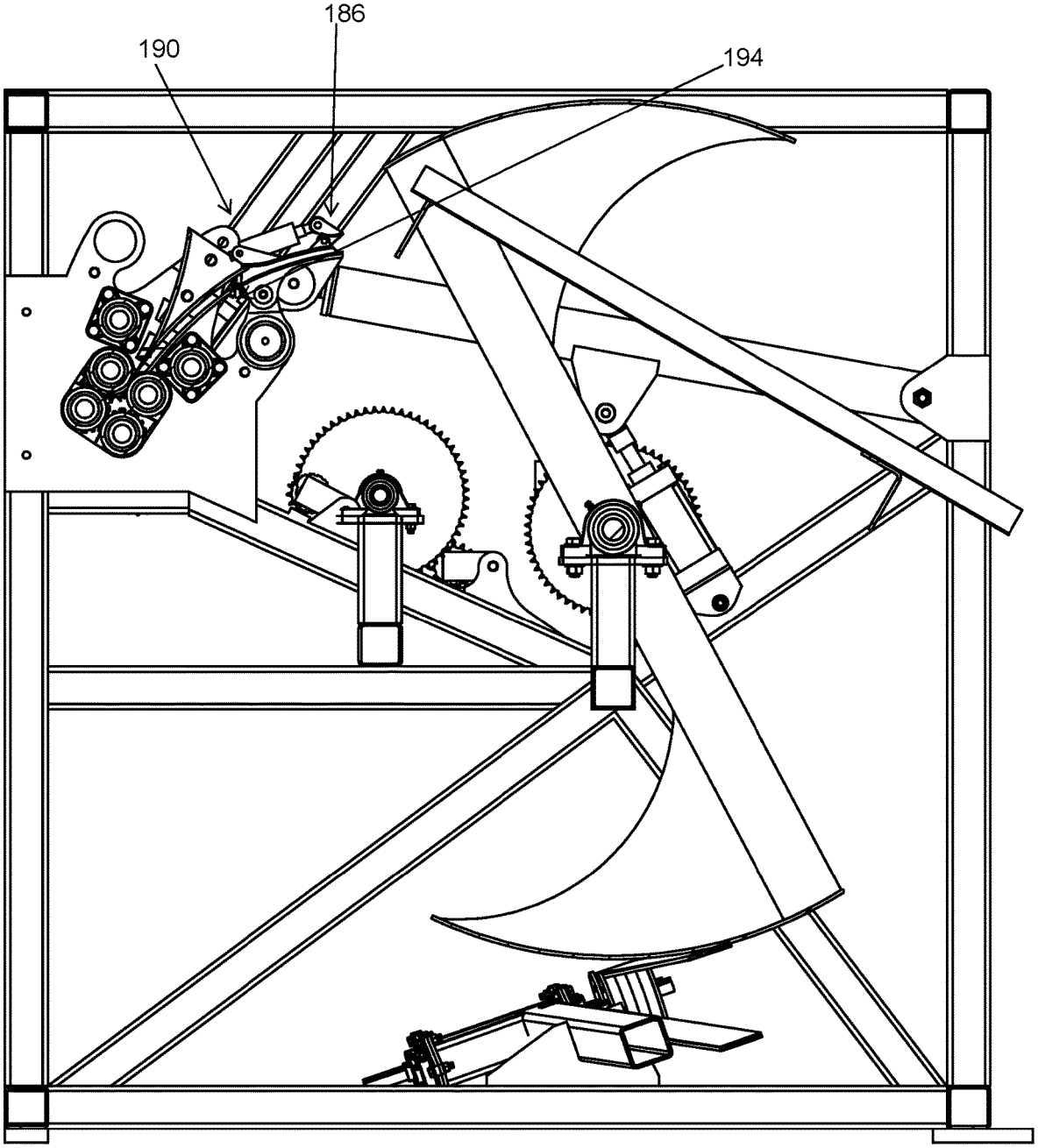
FIGS. 11 through 15 are side elevation views of the apparatus of FIG. 7, illustrating the movement and interaction of infeed, splitter, separation and stripper components.

It will be apparent that the decorticating apparatus 130 is configured to simultaneously receive and process numerous hemp stalks (in discrete, substantially aligned groups). However, for simplicity, in what follows, the operation of the decorticating apparatus 130 is described with respect to a single hemp stalk. The hemp stalk and flat stalk piece are not shown in FIGS. 7-16, but the positioning and processing of the hemp stalk and flat stalk piece are described with reference to the drawings, in what follows In use, a section of hemp stalk is brought into engagement with the infeed assembly 134, and the hemp stalk is thereby split into two flat stalk pieces by the V-shaped splitter 160. A one of the flat stalk pieces is propelled into the splitter duct 166 and the separator body duct 176 (which is in the stalk-receiving position 190 as illustrated in FIGS. 10 and 11).

Figure 12:
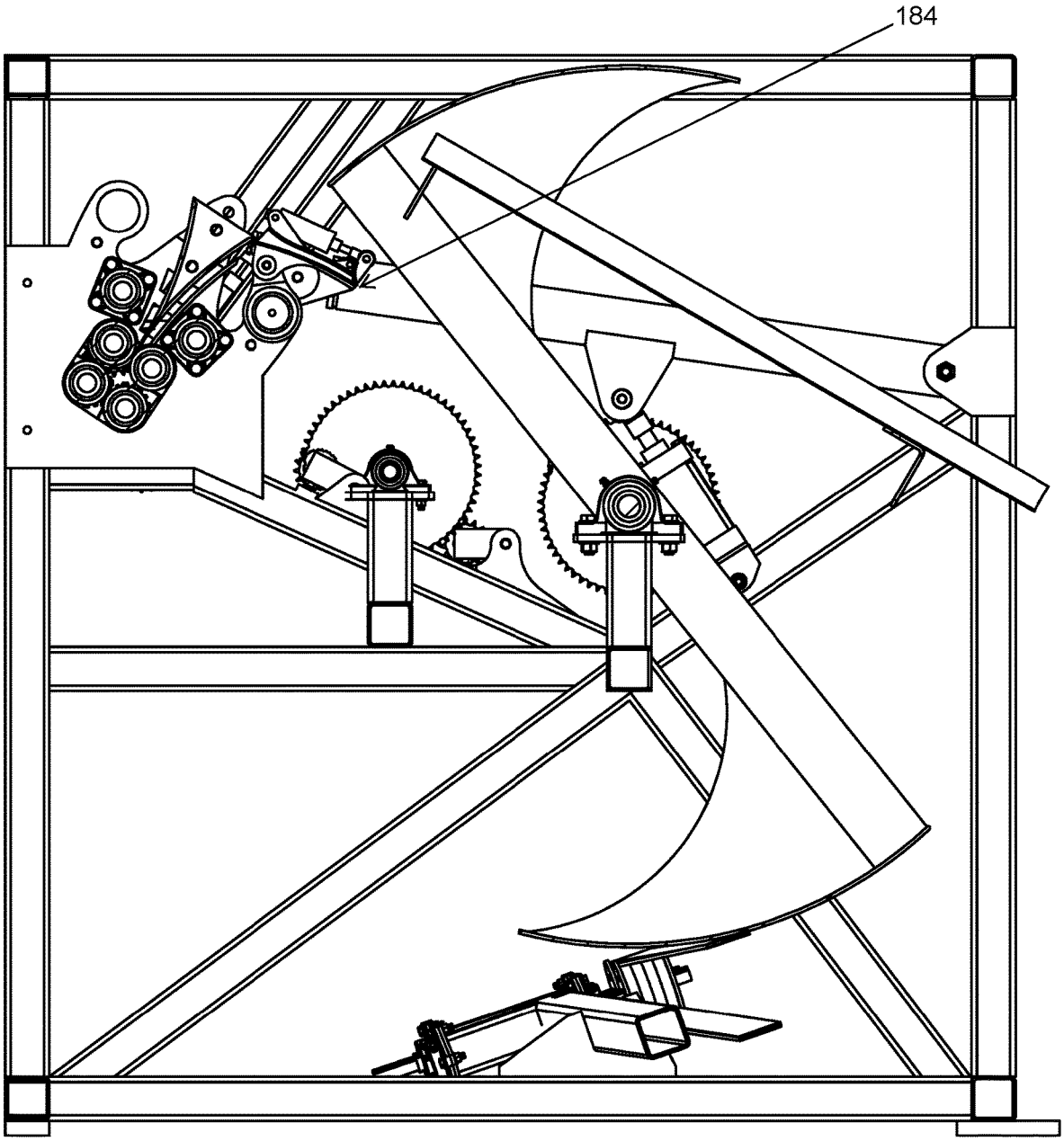
Figure 13:
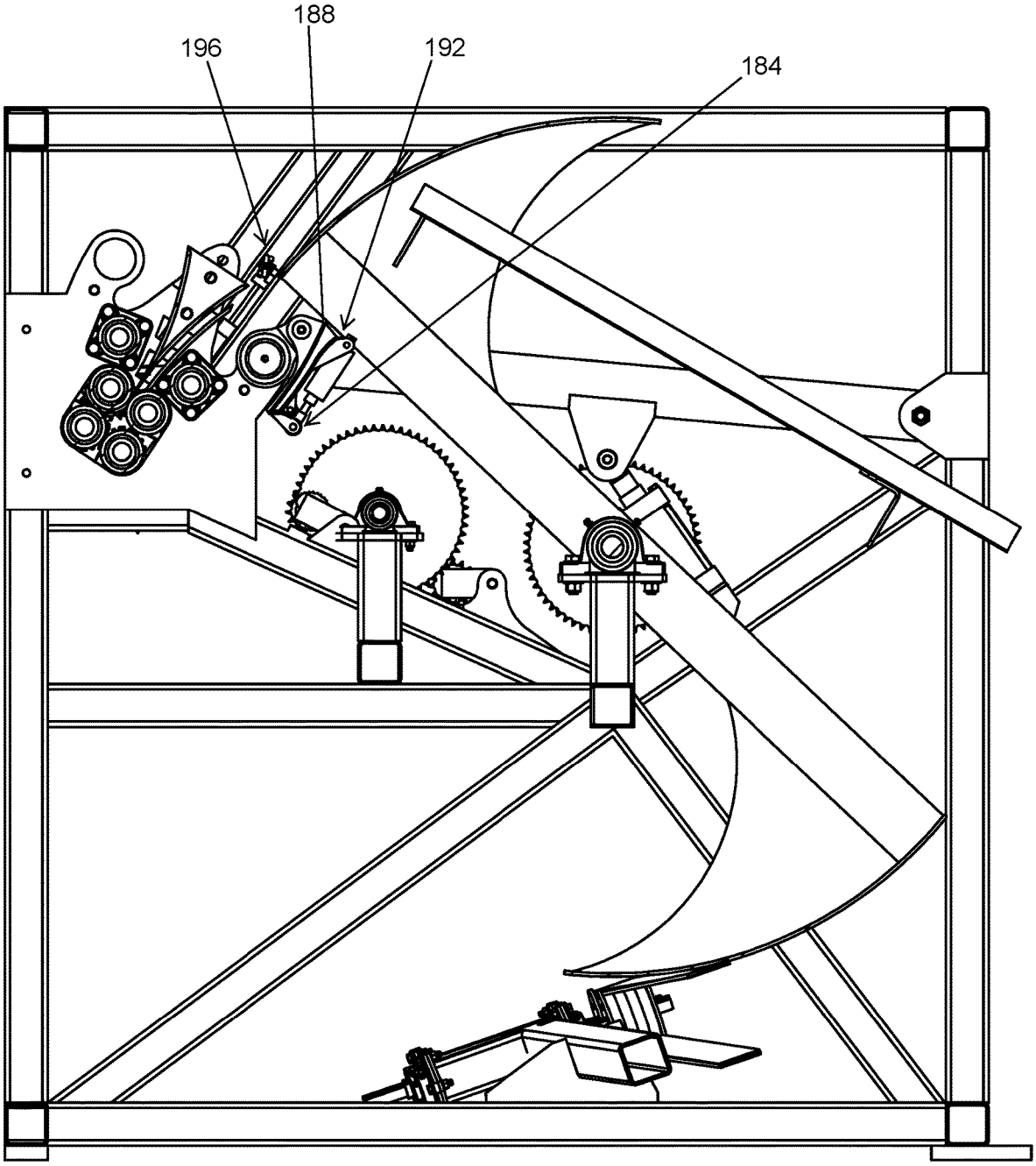
Figure 14:
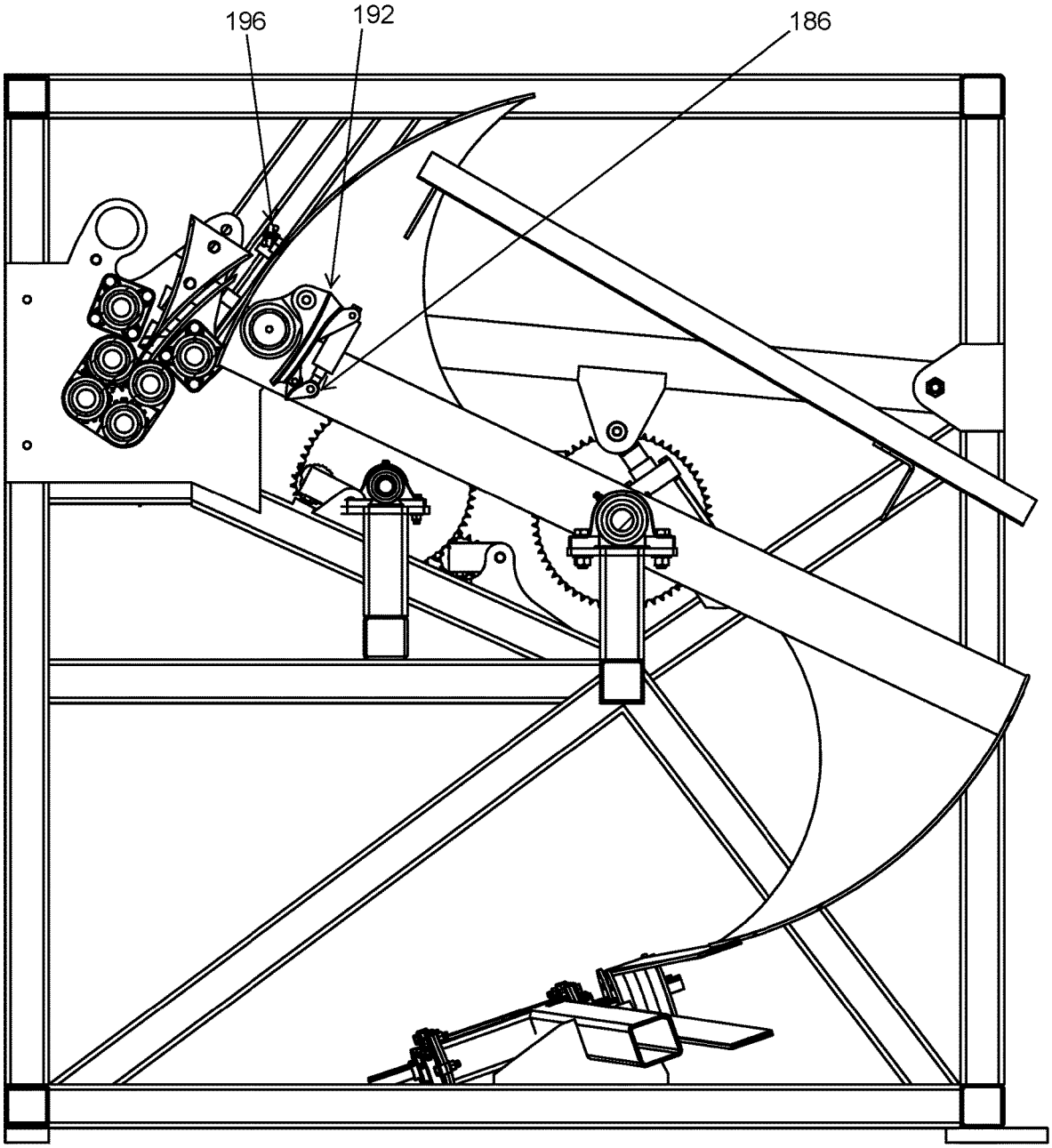
Figure 15:
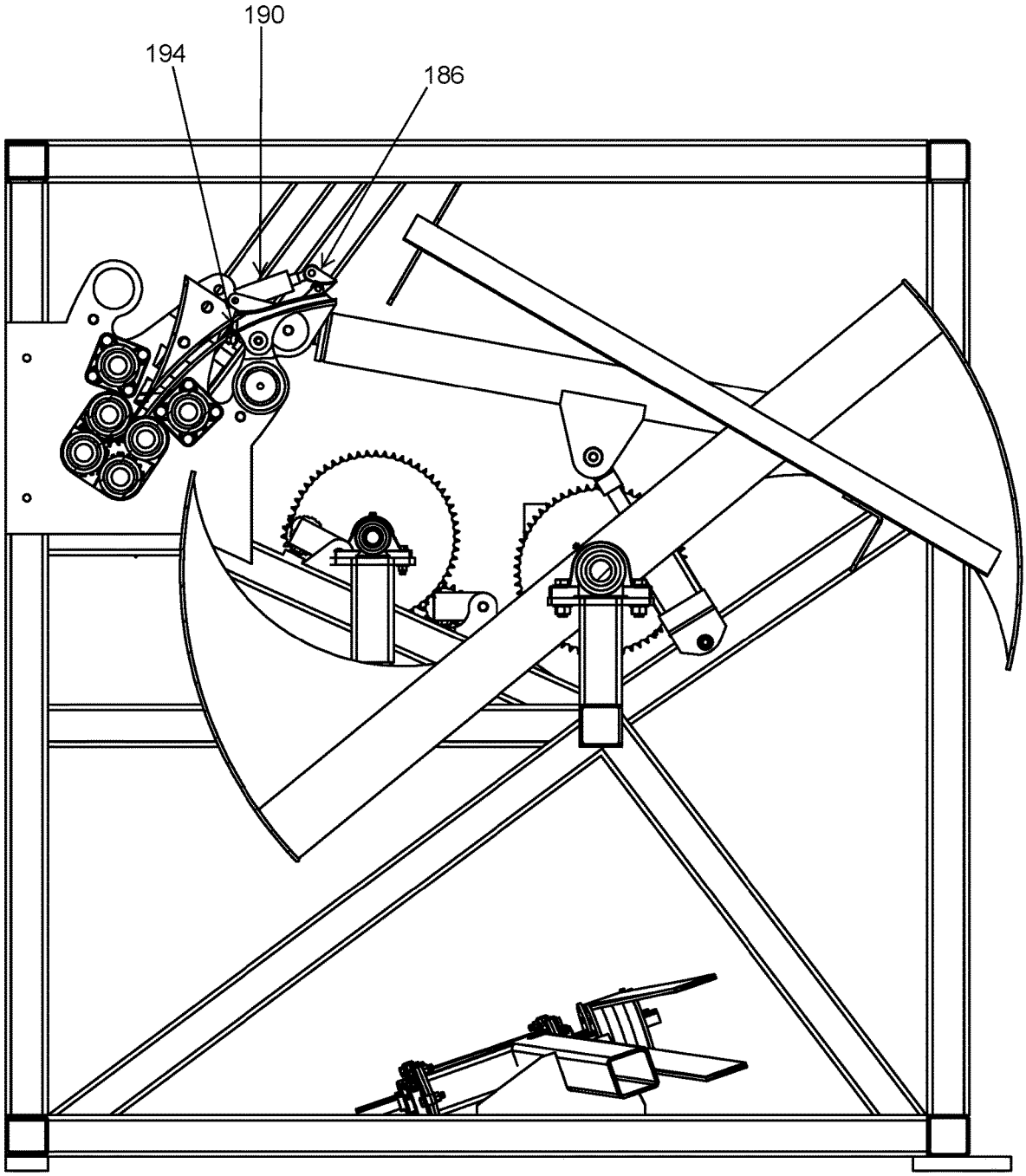

As illustrated in FIGS. 12 and 13, once a flat stalk piece reaches the separator body duct 176, the separator body duct 176 moves towards the separation position 192, creating a gap between the distal end of the splitter duct 166 and the proximal end of the separator body duct 176, and the draw bar 200 moves through the gap towards the turn position 196. The operation of the infeed assembly 134 provides a continuous feed of the flat stalk piece during these movements, thus accommodating the displacement of the components. During these movements of the separator body duct 176 and the draw bar 200, the draw bar 200 and separator draw 188 are briefly sufficiently adjacent to essentially create a single bend in the flat stalk piece (thus breaking the bast 108 at the bend). Once the separator body 174 is in the position indicated in FIG. 12, i.e., with the splitter duct 166 and the separator body duct 176 approaching roughly 90 degrees to each other, the clamp cam 180 moves from the clear position 186 to the clamp position 184.

Thereafter, as the draw bar 200 and separator body duct 176 respectively move towards the turn position 196 and the separation position 192, the draw bar 200 and the separator draw 188 each cause a turn that moves along the bast 110 and that thus separates the bast 110 from the hurd 108 as the turn passes. During these movements, the clamp cam 180 being in the clamp position 184 impedes movement of the portion of the flat stalk piece within the separator body duct 176, maintaining a desired tension on the bast.

As illustrated in FIG. 13, with the draw bar 200 in the turn position 196, the separator body duct 176 in the separation position 192, and a portion of bast spanning the gap between the draw bar 200 and the separator draw 188, a one of the stripper blades 214 contacts the hurd side of the gap spanning bast. Prior to, or essentially concurrently with, the stripper blade 214 contacting the gap spanning bast, the clamp cam 180 moves from the clamp position 184 to the clear position 186.

The leading edge of stripper blade 214 passes between the draw bar 200 and the separator draw 188, creating a fold in the gap-spanning bast and drawing the bast from the draw bar 200 and the separator draw 188, creating a moving turn in the bast at each of the draw bar 200 and the separator draw 188, that thus separates the bast from the hurd as each turn passes.

The outer face of the stripper blade 214 (outer in terms of distance from the stripper shaft 212) engages the friction roller 216, which, while rotating responsive to the engagement (or alternatively, as driven to rotate with the same circumferential velocity as the outer face of the stripper blade 214), presses against the bast on the outer face of the stripper blade 214, so as to prevent slippage of the bast (i.e., impede relative movement between the outer face of the stripper blade 214 and the bast folded about the leading edge of the stripper blade 214). The prevention of slippage results in the bast being pulled essentially equally past the separator draw 188 and the draw bar 200. To be clear, it is desirable for the fold to be at the center of the lengths of bast or for there to be a longer portion of bast on the infeed/splitter end of the bast than on the separator end of the bast, to avoid slippage of the bast at the fold. Slippage may occur if there is more bast on the separator end of the bast.

Once all of the bast has been pulled past the separator draw 188 and the draw bar 200, the draw bar 200 moves to the retracted position 194 and the separator body 174 moves to the stalk-receiving position 190.

The stripper blade 214 leaves the vicinity of the separator assembly 170 and the movable draw assembly 172, with bast substantially free of hurd, folded about the leading edge of the stripper blade 214. Further rotation of the stripper beam brings the leading edge of the stripper blade 214 (about which the bast is folded) into contact with the rotatable belt 220, which (facilitated by the V notches 222) dislodges the bast from the stripper blade 214 and conveys the bast generally laterally from the frame 132.

Figure 16:
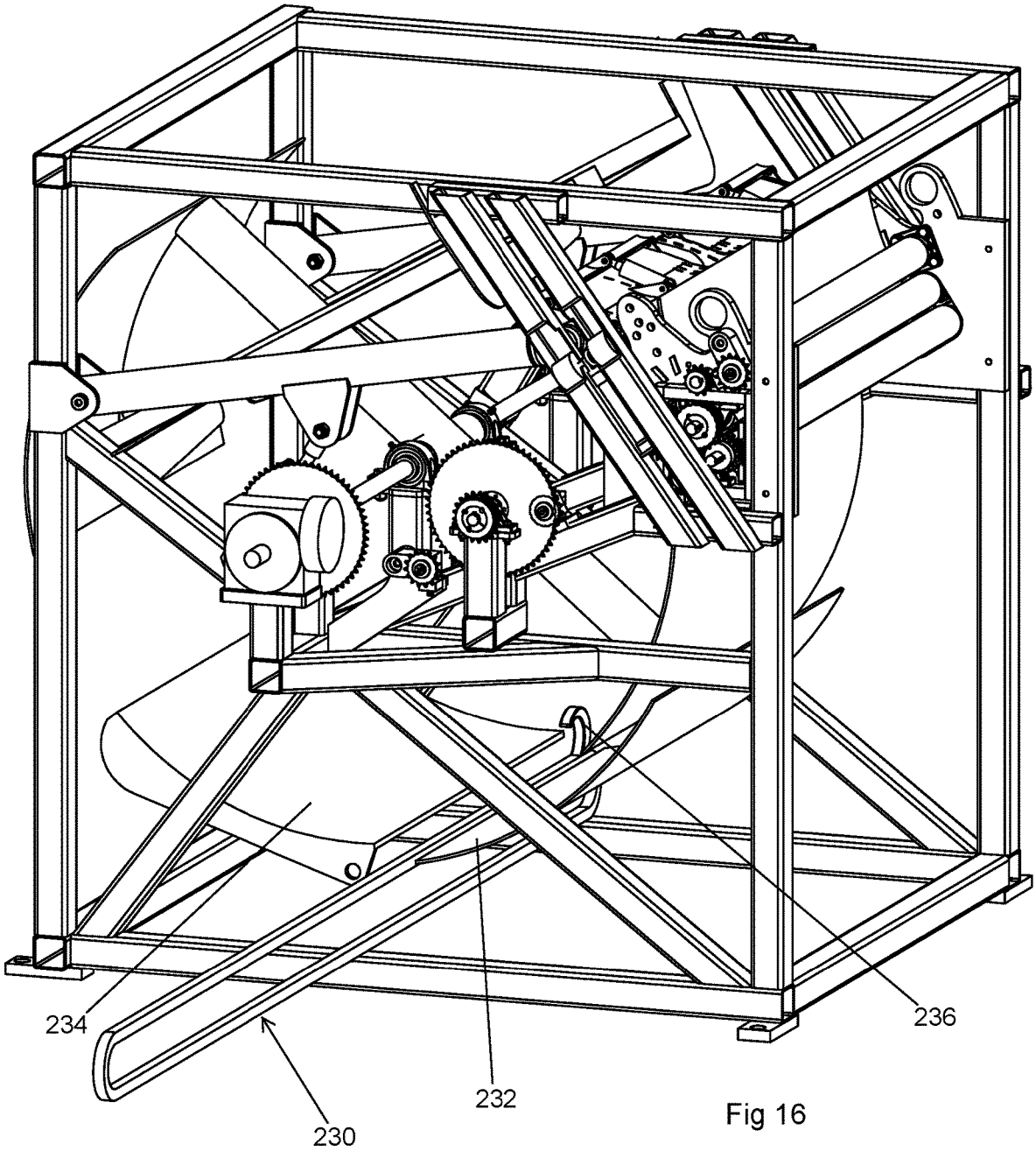
FIG. 16 is a perspective view of an embodiment of the present invention having a shoe-type extractor.

FIG. 16 illustrates an alternative to the bast extraction conveyor assembly 142, being a shoe-type extractor 230. The shoe-type extractor 230 comprises: a bast receiving bed 232 (for receiving the portion of the bast on the outer face of a passing stripper blade 214); a bast pad 232 (for resiliently biasing against the passing stripper blade 214 to unfold the bast from about the leading edge of the stripper blade 214, so as to receive the bast from the inner face of the passing stripper blade 214); and a bundle hook 236 (for engaging the unfolded bast and moving it laterally from the frame 132).

The scope of the claims should not be limited by the preferred embodiments set forth in the examples, but should be given the broadest interpretation consistent with the description as a whole.

What is claimed is:

1. A method for decorticating a piece of a plant stalk comprising an outer bast and an inner hurd, the method comprising:

a) splitting a piece of plant stalk lengthwise to create a plurality of plant stalk sections each having a bast, a hurd and two ends;

b) bending a plant stalk section of the plurality of plant stalk sections about a bend member comprising a first draw edge and a second draw edge to create a bend in said plant stalk section with the hurd on an outside of the bend and the bast on an inside of the bend so as to break the hurd without severing the bast;

c) separating the first draw edge and the second draw edge along the bast so as to separate the bend into a first turn and a second turn and cause the first turn and the second turn to move away from each other along the bast, thus separating the bast from the hurd as the first turn and the second turn pass, resulting in a portion of the bast spanning a gap between the first draw edge and the second draw edge;

d) drawing the portion of the bast spanning the gap past the first draw edge and the second draw edge so as to cause the first turn and the second turn to move along the bast to the two ends of said plant stalk section thus separating the bast from the hurd; and e) wherein the plant stalk section undergoes b), c) and d) in a sequential progression until d) has been performed on an entire length of the plant stalk section and wherein the plant stalk section undergoes one or more of b), c) and d) contemporaneously with the piece of plant stalk being split lengthwise in a).

2. The method of claim 1, further comprising flattening the piece of plant stalk prior to or concurrently with the splitting the piece of plant stalk.

3. The method of claim 2, wherein the flattening the piece of plant stalk comprises passing the piece of plant stalk between opposed rollers.

4. The method of claim 1, wherein the drawing the portion of the bast spanning the gap past the first draw edge and the second draw edge comprises moving a stripper member through the gap between the first draw edge and the second draw edge so as to fold the bast about the stripper member.

5. The method of claim 4, further comprising removing the bast from the stripper member.

6. The method of claim 1, wherein the plurality of plant stalk sections comprise two plant stalk sections.

7. A method for decorticating a piece of a plant stalk comprising an outer bast and an inner hurd, the method comprising:

a) splitting a piece of plant stalk lengthwise to create a plurality of plant stalk sections each having a bast, a hurd and two ends;

b) bending a plant stalk section of the plurality of plant stalk sections about a bend member to create a bend in said plant stalk section with the hurd on an outside of the bend and the bast on an inside of the bend so as to break the hurd without severing the bast, and introducing a draw edge in contact with the bast on the inside of the bend and adjacent the bend member;

c) separating the bend member and the draw edge along the bast so as to separate the bend into a first turn and a second turn and cause the first turn and the second turn to move away from each other along the bast, thus separating the bast from the hurd as the first turn and the second turn pass, resulting in a portion of the bast spanning a gap between the bend member and the draw edge;

d) drawing the portion of the bast spanning the gap past the bend member and the draw edge so as to cause the first turn and the second turn to move along the bast to the two ends of said plant stalk section thus separating the bast from the hurd; and e) wherein the plant stalk section undergoes b), c) and d) in a sequential progression until d) has been performed on an entire length of the plant stalk section and wherein the plant stalk section undergoes one or more of b), c) and d) contemporaneously with the piece of plant stalk being split lengthwise in a).

8. The method of claim 7, wherein the drawing the portion of the bast spanning the gap past the bend member and the draw edge comprises moving a stripper member through the gap between the bend member and the draw edge so as to fold the bast about the stripper member.

9. A method for decorticating a piece of a plant stalk comprising an outer bast and an inner hurd, the method comprising:

a) splitting a piece of plant stalk lengthwise to create a plurality of plant stalk sections each having a bast, a hurd and two ends;

b) bending a plant stalk section of the plurality of plant stalk sections about a bend member comprising a first draw edge and a second draw edge to create a bend in said plant stalk section with the hurd on an outside of the bend and the bast on an inside of the bend so as to break the hurd without severing the bast, and positioning the first draw edge in contact with the bast on the inside of the bend on one side of the bend member and positioning the second draw edge in contact with the bast on the inside of the bend on an opposite side of the bend member;

c) separating the first draw edge and the second draw edge along the bast so as to separate the bend into a first turn and a second turn and cause the first turn and the second turn to move away from each other along the bast, thus separating the bast from the hurd as the first turn and the second turn pass, resulting in a portion of the bast spanning a gap between the first draw edge and the second draw edge;

d) drawing the portion of the bast spanning the gap past the first draw edge and the second draw edge so as to cause the first turn and the second turn to move along the bast to the two ends of said plant stalk section thus separating the bast from the hurd; and e) wherein a), b), c) and d) are performed on the same piece of plant stalk in a sequential progression until d) has been performed on an entire length of said plant stalk section.

10. The method of claim 9, wherein the drawing the portion of the bast spanning the gap past the first draw edge and the second draw edge comprises moving a stripper member through the gap between the first draw edge and the second draw edge so as to fold the bast about the stripper member.

* * * * *